US007563108B1

(12) United States Patent
Wu

(10) Patent No.: US 7,563,108 B1
(45) Date of Patent: Jul. 21, 2009

(54) LOW PROFILE CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/218,880

(22) Filed: Jul. 18, 2008

(51) Int. Cl.
*H01R 12/00* (2006.01)

(52) U.S. Cl. ..... 439/76.1; 439/902

(58) Field of Classification Search ..... 439/76.1, 439/902, 881, 694, 855
See application file for complete search history.

(56) References Cited

U.S. PATENT DOCUMENTS 6,095,825 A * 8/2000 Liao ..... 439/76.1
6,179,662 B1 * 1/2001 Kuo ..... 439/607
6,913,489 B2 7/2005 Chai et al.
6,948,949 B1 * 9/2005 Schwartz et al. ..... 439/76.1
7,018,231 B2 3/2006 Liu et al.
2008/0214054 A1 * 9/2008 Su et al. ..... 439/637
2008/0280495 A1 * 11/2008 Ko ..... 439/638

* cited by examiner

*Primary Examiner*—Tho D Ta
(74) *Attorney, Agent, or Firm*—Wei Te Chung

(57) ABSTRACT

An cable assembly (100) includes an insulated housing (10); a plurality of contacts (14) received in the insulated housing, with tail portions thereof disposed outside of insulated housing; a printed circuit board (2) including a mounting portion and a connecting portion, with the mounting portion arranged adjacent to a back surface of the insulated housing, the connecting portion arranged aside the insulated housing; a cable (3) coupled to the connecting portion of the printed circuit board and extending laterally along a direction perpendicular to the insulated housing, a cover (4) attached to the insulated housing and the printed circuit board and retaining means utilized to secure the insulated housing and the printed circuit board together.

11 Claims, 6 Drawing Sheets

LOW PROFILE CABLE ASSEMBLY

FIELD OF THE INVENTION

The present invention generally relates to a cable assembly, and more particularly to a low profile cable assembly.

DESCRIPTION OF PRIOR ART

Serial Advanced Technology Attachment (SATA) is a computer bus (or interface) primarily designed for transfer data between a computer and storage devices (like hard disk drives or optical drives). SATA offers performance as high as 3.0 Gbit/sec per device with the current specification. SATA utilizes only four signal lines, allowing much more compact (and less expensive) cables compared with PATA.

A SATA cable assembly is widely used in a computer or a server for data transmitting. U.S. Pat. No. 6,913,489 issued to Chang on Jul. 5, 2005 disclose a high frequency cable assembly. The cable assembly has a connector coupled to an end of high frequency cable. The connector includes an insulated body containing a plurality of contacts connected to interior wires of the cable, a metal shield wrapping the insulated body and an elongated external packaging molded over the external portion of the insulated body and a connection area between rear portions of the contacts and wires adjacent thereto. However, a length of the aforementioned connector along a mating direction inevitably increased, as external packaging is needed to attached to the insulated body to enhance the combination between the insulated body and the cable.

U.S. Pat. No. 7,018,231 issued to Liu et al. on Mar. 28, 2006 discloses another cable end connector assembly. The connector assembly includes an insulative housing, a number of contacts, a cable, a casing and a cover. The insulative housing defines a L-shaped receiving space. The contacts are received in the insulative housing, each contact comprises a mating portion, a retention portion, and a tail portion extending rearwardly and downwardly from the retention portion. The cable comprises an insulative jacket and a number of conductive cores extending upwardly beyond an upper end of the insulative jacket and connecting with the tail portions of the contacts. A cover is over-molded with the rear portion of the insulative housing and the cable. Compared to the Chang's connector, Liu's connector is much shorter, as it is configured to right angled shape, and rear section of the cover is disposed below the insulative housing, rather than parallel to the insulative housing.

Hence, a lower profile cable assembly with different structure is eagerly required.

SUMMARY OF THE INVENTION

Accordingly, an object of the present invention is to provide a low profile cable assembly, which is simple and manufactured easily.

In order to achieve the object set forth, a cable assembly in accordance with the present invention comprises an insulated housing; a plurality of contacts received in the insulated housing, with tail portions thereof disposed outside of insulated housing; a printed circuit board including a mounting portion and a connecting portion, with the mounting portion arranged adjacent to a back surface of the insulated housing, the connecting portion arranged aside the insulated housing; a cable coupled to the connecting portion of the printed circuit board and extending laterally along a direction perpendicular to the insulated housing; a cover attached to the insulated housing and the printed circuit board, and retaining means utilized to secure the insulated housing and the printed circuit board together.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
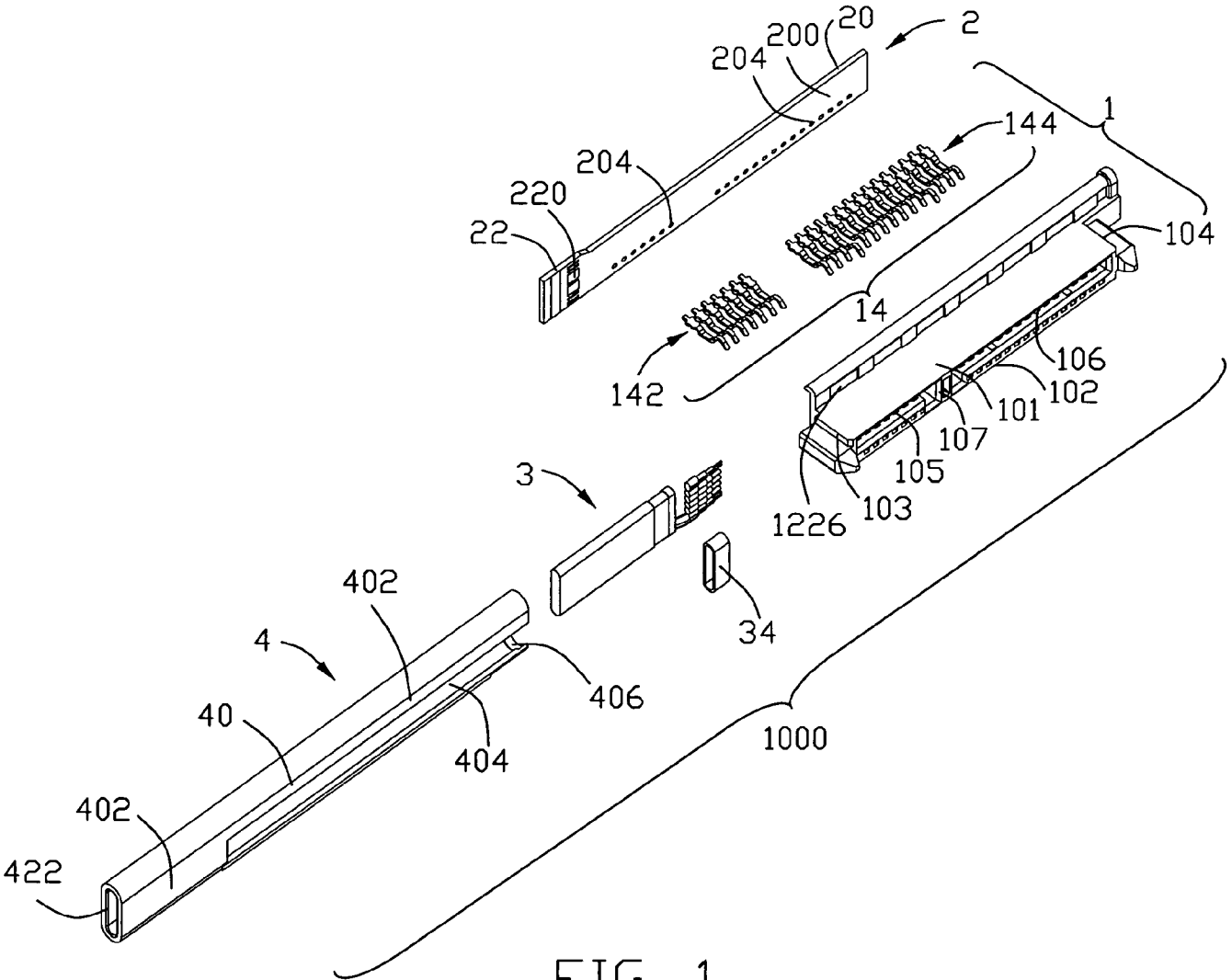
FIG. 1 is an exploded, perspective view of a cable assembly in accordance with the present invention.
Figure 2:
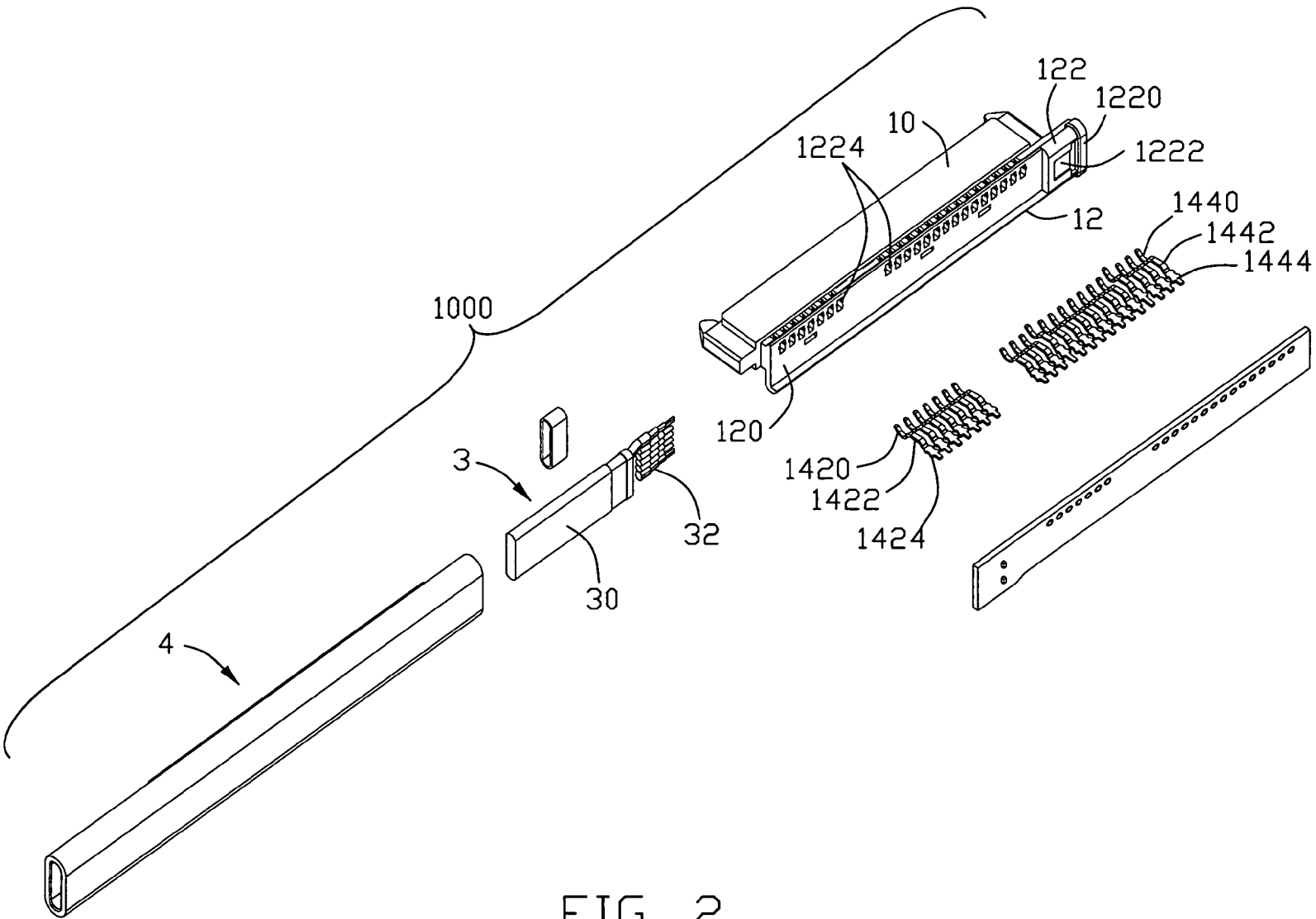
FIG. 2 is similar to FIG. 1, but viewed from another aspect.
Figure 3:
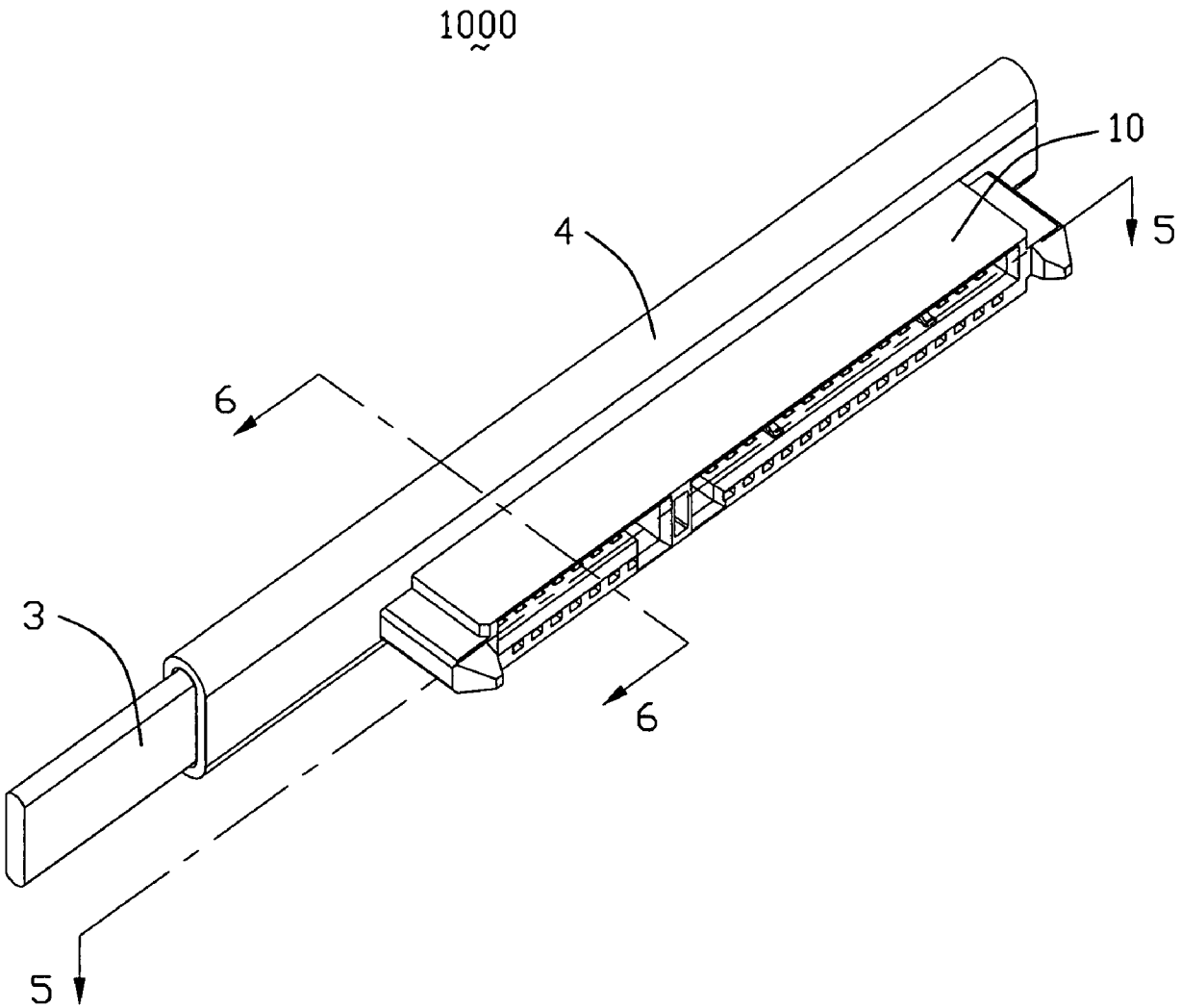
FIG. 3 is an assembled, perspective view of cable assembly.
Figure 4:
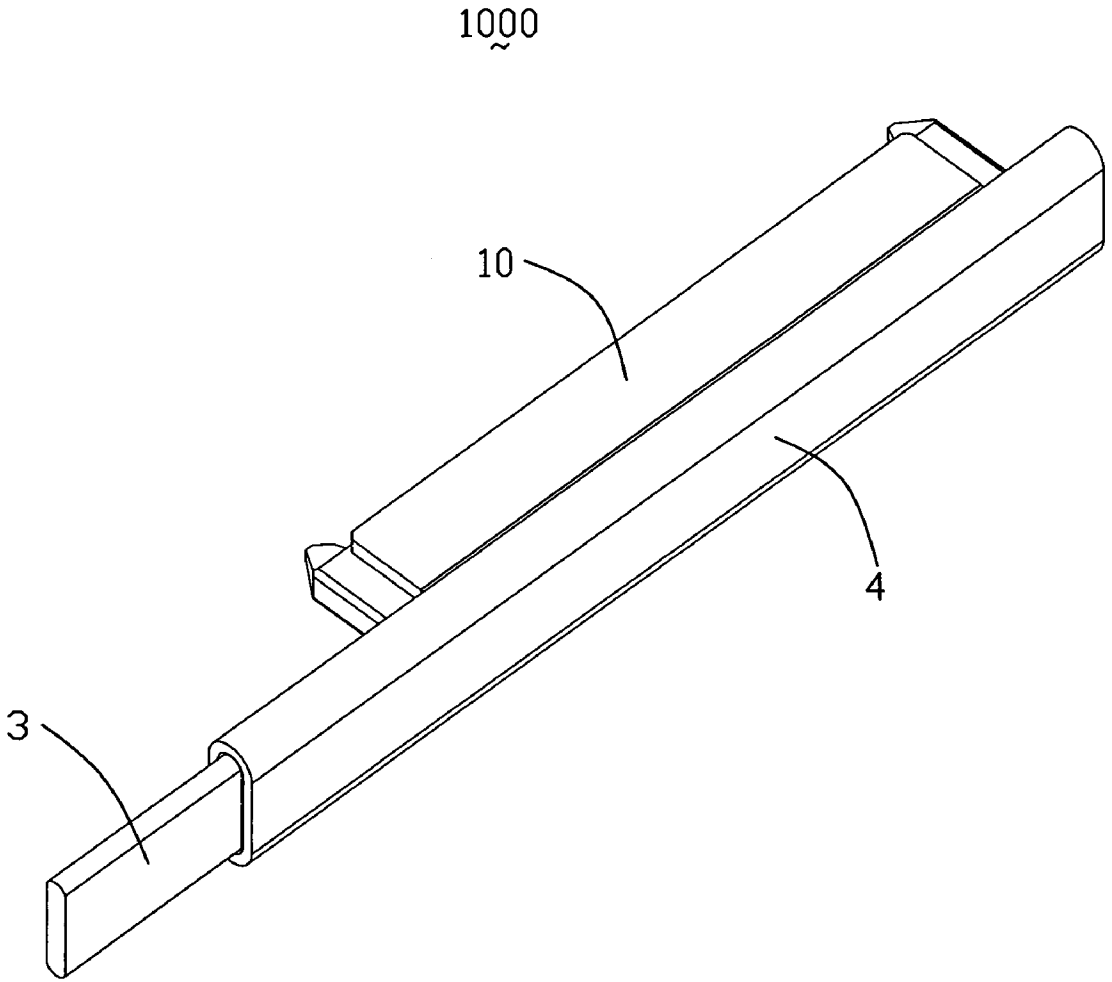
FIG. 4 is similar to FIG. 3, but viewed from another aspect.
Figure 5:
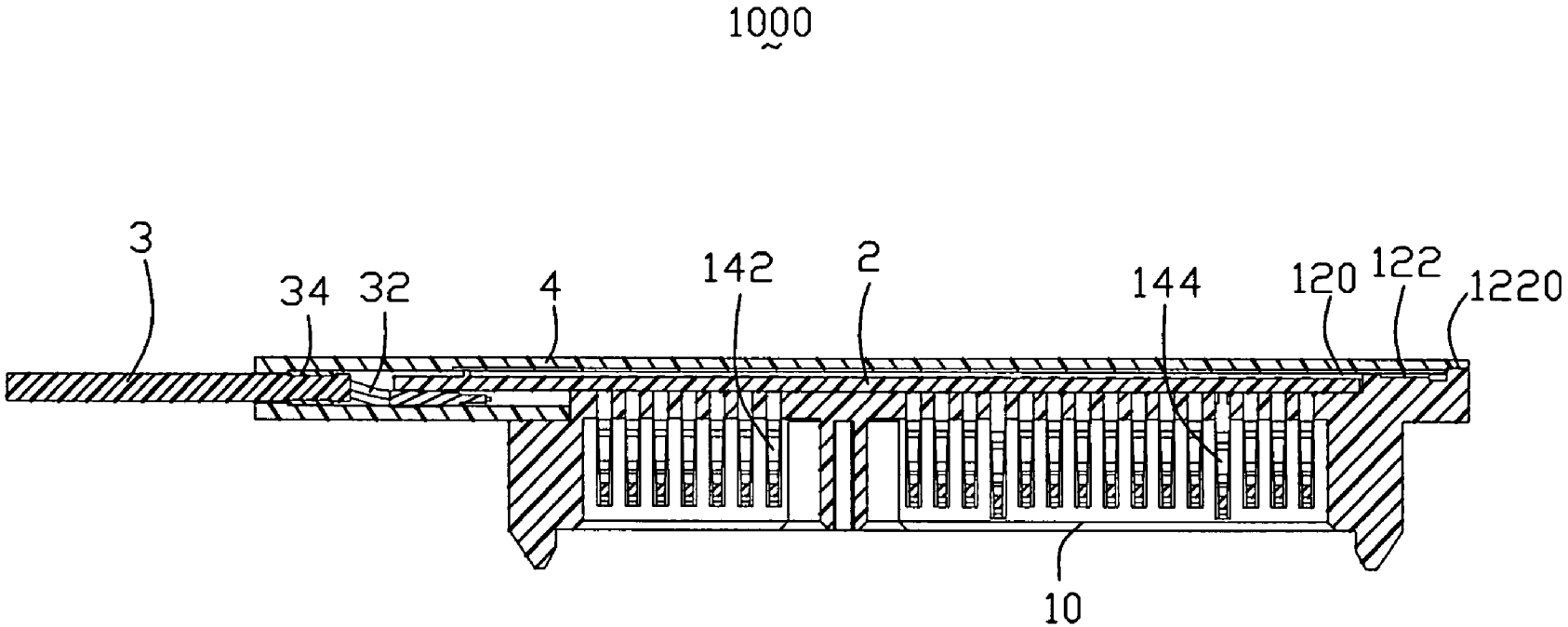
FIG. 5 is a cross-section view of FIG. 3 taken along line 5-5.
Figure 6:
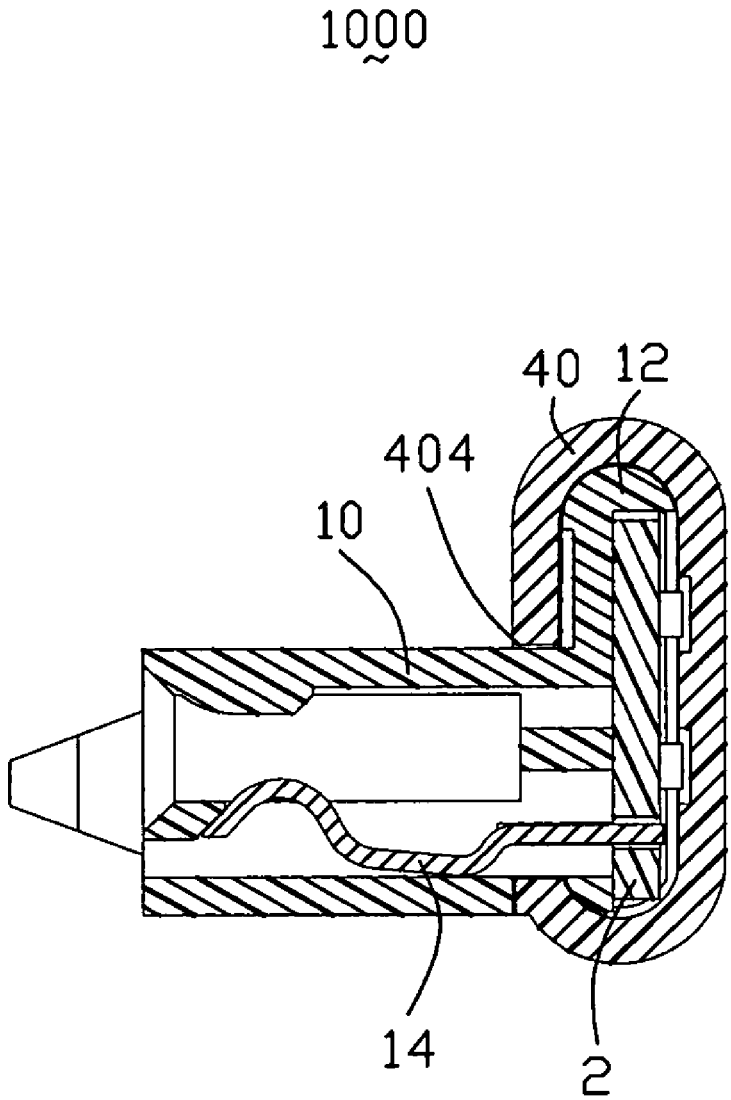
FIG. 6 is a cross-section view of FIG. 3 taken along line 6-6.

Referring to FIGS. 1-8, a cable assembly 1000 in accordance with the present invention comprises a connector 1, a printed circuit board (PCB) 2, a cable 3 and a cover 4.

The connector 1 includes an elongate insulated housing 10 and a plurality of contacts 14 received therein. The insulated housing 10 has an up wall 101, a bottom wall 102, a pair of side walls 103, 104 connecting with the up wall 100 and the bottom wall 102 to form mating portion. A block member 107 is intervened into a hollow portion of the mating portion to divide it into two L-shaped individual ports 105, 106. The insulated housing 10 further has an elongate base portion 12 is attached to rear surfaces thereof. The base portion 12 surpasses top surfaces of the up wall 100, low surface of the bottom wall 102 and outer surface of the side wall 104. A sunken portion 120 is recessed forwardly from back surface of the base portion 120, with a stopper member 122 remained at a lateral section thereof. A flange portion 1220 is formed at an end portion of the stopper member 122. A cavity portion 1222 is defined in the stopper member 122 and disposed inside the flange portion 1220. A plurality of slots 1224 are defined in the base portion 12 and in communication to the sunken portion 120 and the ports 105, 106. A number of grooves 1226 are arranged in a front portion of the base portion 12.

The contacts 14 are separated into a group of first contacts 142 for transmitting signal and a group of second contacts 144 for transmitting power. Either the first contact 142 or the second contact 144 includes mating portions 1420, 1440 extending into the ports 105, 106, main portions 1422, 1442 retained in the slots 1224, and tail portions 1424, 1444 disposed beyond the base portion 12.

The PCB 2 includes an elongate mounting portion 20 and a connecting portion 22. The mounting portion 20 has a mounting surface 200 adapted for mounting the insulated housing 10. A row of first conductive holes 202 and other row of second conductive holes 204 are arranged in the mounting portion 20 and through the mounting surface 200. A set of conductive pads 220 are formed on the connecting portion 22 and perpendicular to the first conductive holes 202 and the second conductive holes 204. The tail portions 1424, 1444 of the first and second contacts 142, 144 are inserted into the first and second conductive holes 202, 204 and soldered therein.

The cable 3 has an outer jacket 30 and a number of wires 32 inside the jacket 30. Partial of a front portion of the jacket 30 is removed, with the wires 32 exposed outside. A metal ring 34 is crimped to a front end of jacket 30 for strain relief. The wires 32 are respectively soldered to the conductive pads 220 of the PCB.

The cover 4 is substantially a flat-shaped tube member, made of plastic or other insulated material. The cover 4 includes an engaging portion 40 and a retention portion 42 connected thereto. Partial of a front portion 402 of the engaging portion 40 is cut to form a front outlet 404. The end of the engaging portion 40 defines a depression portion 406, and the end of the retention portion 42 forms a protrusion portion 422.

When assembly, the contacts 14 are inserted to the insulated housing 10, then the mounting portion 20 of the PCB 2 is laid in the sunken portion 120 of the base portion 12 and the connecting portion 22 disposed out the left side of the insulated housing 10, with tail portions 1424, 1444 of the contacts 14 extending through the conductive holes 202, 204 of mounting portion 20 and soldered therein. Secondly, the wires 32 of the cable 3 are soldered to the conductive pads 220 of the connecting portion 22. Thirdly, the cover 4 is mounted to the connector 1, with the mating portion of the insulated housing 10 extending outward through the front outlet 402, the base portion 12 held by engaging portion 40, the flange portion 1220 locked in the depression portion 406, the connecting portion 22 and the wires 32 soldered thereon accommodated in the retention portion 42, the metal ring 34 against protrusion portion 422. Glue (not shown) is applied to the cavity portion 1222 and grooves 1226 of the base portion 12 to ensure the cover 4 and the connector 1 combined reliably. Other retaining means, such rivet or screw etc. may available for retaining the cover 4 and the connector 1 or the insulated housing 10 together securely. The cable 3 extends laterally along a direction perpendicular to the insulated housing 10, therefore a length of the connector 1 along a mating direction may be reduced.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising: an insulated housing extending along a lengthwise direction with an elongated mating port communicating with an exterior in a front-to-back direction;

a plurality of contacts received in the insulated housing, with tail portions thereof disposed outside of the insulated housing;

a printed circuit board including a mounting portion and a connecting portion, with the mounting portion arranged adjacent to a back surface of the insulated housing, the connecting portion arranged aside the insulated housing;

a cable coupled to the connecting portion of the printed circuit board and extending laterally along a direction perpendicular to the front-to-back direction;

a cover extended along the lengthwise direction and attached to the insulated housing and the printed circuit board; and retaining means utilized to secure the insulated housing and the printed circuit board together;

wherein the cover has an engaging portion combined with a rear portion of the insulated housing and a retention enclosing the connecting portion of the printed circuit board;

wherein a base portion is connected to the rear portion of the insulated housing and held by the engaging portion;

wherein a sunken portion is recessed forwardly from a back surface of the base portion, with the mounting portion of the printed circuit board received therein;

wherein a stopper member is located at an end of the base portion and disposed aside the sunken portion;

wherein the engaging portion defines a depression portion, wherein a flange portion is formed on an end of the stopper member and located in the depression portion.

2. The cable assembly as recited in claim 1, wherein at least a groove is defined in the base portion, and glue is utilized as retaining means which is applied to a groove to make the cover and the base portion combined together securely.

3. The cable assembly as recited in claim 1, wherein a cavity portion is defined in the stopper member accommodating glue.

4. The cable assembly as recited in claim 1, wherein a metal ring is attached to a front portion of the cable and received in the retention portion of the cover.

5. The cable assembly as recited in claim 1, wherein a plurality of conductive holes are defined in the mounting portion to receive the tail portions of the contacts.

6. A cable assembly, comprising:

a connector having a mating portion and an elongated base portion connected thereto;

the elongated base portion extending along a lengthwise direction with the mating portion communicating with an exterior in a front-to-back direction;

a plurality of contacts extending into the mating portion along the front-to-back direction, with tail portions thereof disposed outside of the elongated base portion;

an elongated printed circuit board including a mounting portion and a connecting portion, said elongated base portion mounted to mounting portion of the printed circuit board;

a cable coupled to the connecting portion of the printed circuit board and extending along the lengthwise direction perpendicular to the front-to-back direction;

a tube-shaped cover having a retention portion and an engaging portion with an outlet defined in a front portion thereof, said cover assembled to the connector, with the elongated base portion held by the engaging portion, the mating portion extending outward via the outlet of the engaging portion, the connecting portion received in the retention portion, and the cable extending outward via retention portion of the cover;

and retaining means used to make the insulated housing and the printed circuit board securely combined together;

wherein a sunken portion is defined in a back portion of the base portion to receive the mounting portion of the printed circuit board;

wherein a stopper member is located at an end of the base portion and disposed aside the sunken portion;

wherein the engaging portion defines a depression portion, wherein a flange portion is formed on an end of the stopper member and located in the depression portion.

7. The cable assembly device as recited in claim 6, wherein grooves are defined in the base portion for glue applied therein to make the insulated housing and the cover combined together.

8. The cable assembly device as recited in claim 6, wherein the tail portions of the contacts are inserted into conductive holes and soldered therein.

9. The cable assembly device as recited in claim 6, wherein a metal ring is crimped to a front portion of the cable and received in the retention portion of the cover.

10. A cable connector assembly comprising:

an insulative elongated housing extending along a lengthwise direction with an elongated mating port communicating with an exterior in a front-to-back direction;

a plurality of contacts disposed in the housing and extending along the front-to-back direction;

an elongated printed circuit board positioned behind the mating port, where tails of the contacts are mounted under a condition that said printed circuit board lies in a plane which is perpendicular to said front-to-back direction; a flat type cable including a plurality of wires therein connected to an longitudinal end of the printed circuit board in essentially a coplanar manner; wherein a protective cover extending along said lengthwise direction and covering the housing except the mating port, and further covering a front end region of the cable including joints between the wires and the printed circuit board;

wherein a base portion is connected to a rear portion of the insulative elongated housing, and wherein a sunken portion is defined in a back portion of the base portion to receive a mounting portion of the elongated printed circuit board.

11. The cable connector assembly as claimed in claim 10, wherein a width of said cable is similar to that of the printed circuit board.

* * * * *